United States Patent [19]

Marx et al.

[11] 4,371,158

[45] Feb. 1, 1983

[54] SHEET TILTING SUCTION TYPE SEPARATOR

[75] Inventors: Karl Marx, Radebeul; Klaus Winkler, Coswig; Kurt Schmidt; Joachim Jentzsch, both of Karl-Marx-Stadt, all of German Democratic Rep.

[73] Assignee: VEB Kombinat Polygraph "Werner Lamberz" Leipzig, Leipzig, German Democratic Rep.

[21] Appl. No.: 160,100

[22] Filed: Jun. 16, 1980

[30] Foreign Application Priority Data

Mar. 26, 1979 [DD] German Democratic Rep. ... 211780

[51] Int. Cl.[3] ..... B65H 3/08

[52] U.S. Cl. ..... 271/103; 271/93; 271/106; 294/64 R

[58] Field of Search ..... 271/106, 103, 90, 91, 271/92, 93, 20, 98, 105; 294/64 R; 414/121, 128; 92/92

[56] References Cited

U.S. PATENT DOCUMENTS

| | | | |
|---|---|---|---|
| 3,039,767 | 6/1962 | Staines | 271/106 X |
| 3,482,833 | 12/1969 | Schleiden | 271/98 |
| 3,901,502 | 8/1975 | Vits | 271/106 X |
| 3,934,916 | 1/1976 | Baker | 271/106 X |

*Primary Examiner*—Bruce H. Stoner, Jr.
*Attorney, Agent, or Firm*—Michael J. Striker

[57] ABSTRACT

A suction type separating element is assembled of a base body supported for a reciprocating vertical movement above the sheet edge, a hollow cylinder of elastomeric material having a circumferentially variable thickness and being provided in the region of the minimum thickness with an inwardly directed constriction preferably in the form of an annular section. The lower base of the elastomeric cylinder is terminated with a suction head adapted for abutment against the sheet to be lifted. Upon the formation of a vacuum in the hollow cylinder, the latter deforms in the range of the constriction and lifts the suction head with the sheet portion upwardly.

3 Claims, 3 Drawing Figures

SHEET TILTING SUCTION TYPE SEPARATOR

BACKGROUND OF THE INVENTION

This invention relates generally to a sheet feeding apparatus and more particularly it relates to a sheet tilting suction type separator for use in such a feeding apparatus in sheet manufacturing or processing machines.

Conventionally, the separation of the uppermost sheet on a sheet stack is effected by means of several suction type separating elements.

From the GDR Pat. No. 42850 it is known how to make such separating suction element in the form of sheet tilting separators. This tilting suction type separator consists of a vertically movable foundation body and a suction element arranged in the latter. In operation, these known tilting suction elements due to their vertical movement, impart to the uppermost sheet on a sheet stack a tilting movement during which the trailing edge of the uppermost sheet is tilted upwardly and consequently enables an accurate separation from the underlying sheets. The tilting movement of the suction element is effected by a linkage driven by an additional drive.

The disadvantage of this solution is the relatively high cost of such an additional drive and, moreover, at high working speed the mechanical driving system can properly operate to certain limits only.

SUMMARY OF THE INVENTION

It is, therefore, a general object of the present invention to overcome the aforementioned disadvantages.

More particularly, it is an object of the invention to provide an improved sheet tilting suction type element for separating sheets in a sheet feeding apparatus which has an economically more advantageous structure.

An additional object of the invention is to provide such an improved tilting suction member which is operable even at high separating speeds.

A further object of this invention is to provide such an improved sheet tilting suction member which can operate without the additional driving means.

In keeping with these objects, and others which will become apparent hereafter, one feature of the invention resides, in a sheet feeding apparatus, in the provision of a suction type sheet separating member which includes a rigid base body supported for a reciprocating movement in a vertical direction above a stack of sheets, a suction element connected to the body and including a downwardly projecting hollow cylinder of an elastomeric material, the center axis of the inner surface of the hollow cylinder being offset from the axis of its outer surface to provide a cylindrical wall of a circumferentially variable thickness, and the cylindrical wall having in the range of its smallest thickness a recessed constriction extending parallel to the base area of the hollow cylinder. This recessed constriction has the form of an annulus intersecting the surface of the elastomeric cylindrical wall. The annular constriction extends approximately midway in the projecting elastomeric cylindrical portion and the center radius of the constriction forming annulus coincides with the outer boundary line of the hollow cylinder in the region of the smallest thickness of its wall.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
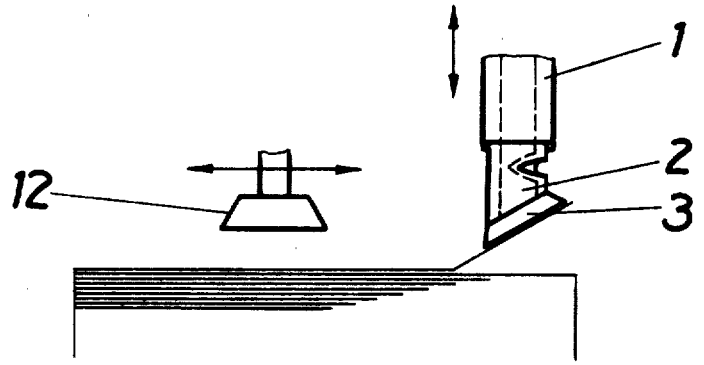
FIG. 1 is a schematic side view of a sheet feeding and separating apparatus having a sheet tilting suction type separator according to this invention.

Referring firstly to FIG. 1, the sheet tilting suction type separator of this invention is arranged for a reciprocating vertical movement above the rear edge 4 of a stack 5 of sheets to be separated. The suction member includes a base body 1, a hollow cylinder 2 of elastomeric material projecting from the base body 1 and a suction head 3. The base body 1 is connected in a conventional manner to a nonillustrated source of suction air. The vertical movement of the whole suction separator 1, 2 and 3 is also effected by a conventional reciprocating drive or by the effect of a biasing spring cooperating with the force of vacuum. Both of the two aforementioned reciprocating drives of suction separators are generally known and therefore are not disclosed in detail.

Figure 2:
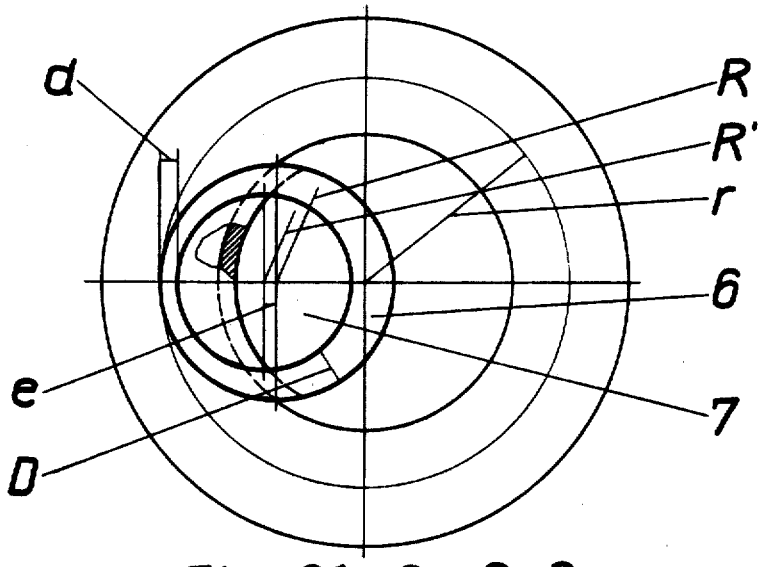
FIG. 2 is a top view partly in section, of the hollow cylinder in the suction member of this invention.
Figure 3:
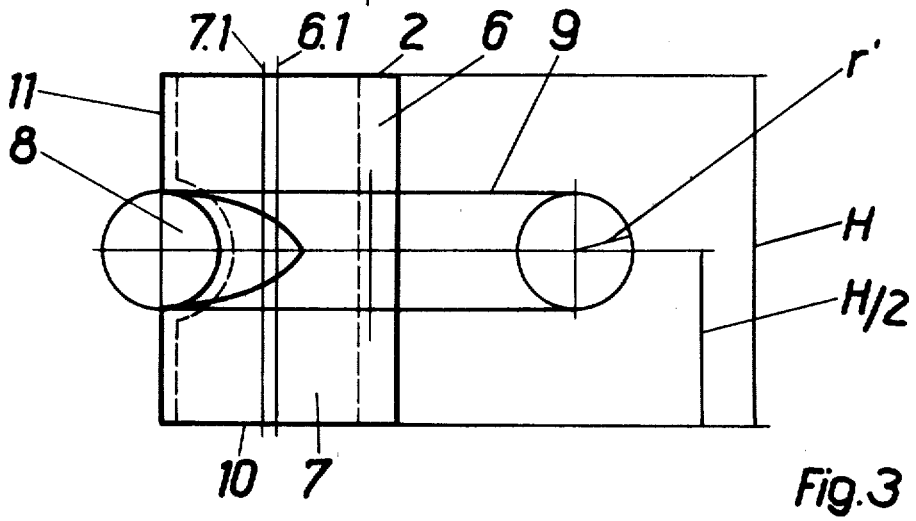
FIG. 3 is a side view of the hollow cylinder of the suction member shown on an enlarged scale.

The hollow cylinder 2 connecting the suction head 3 to the base body 1 is illustrated on an enlarged scale in FIGS. 2 and 3. As mentioned above, the projecting hollow cylinder 2 is made of an elastomeric material and the center axis 6. 1 of its outer cylindrical surface 6 is offset from the center axis 7.1 of its inner cylindrical surface 7. Both center axes 6.1 and 7.1 extend parallel to one another and consequently a cylindrical shell rises which has a circumferentially variable thickness. The radii R and R' of respective cylindrical surfaces 6 and 7 are for example at a ratio of 1:0.75 to one another and the eccentricity or the offset of the two center axes 6.1 and 7.1 is, for example, a tenth part of the radius R of the outer cylindrical surface 6. The minimum thickness of this cylindrical shell or wall is designated by d and the maximum thickness is designated by D.

The projecting part of the elastomeric hollow cylinder has a height H and approximately midway at a distance H/2 is formed in the range of the smallest thickness d with a recessed constriction 8 in the form of an annular section 9 bulging radially into the cylinder 11. The center radius r of the annular section is about 1.75 times the radius R of the outer cylindrical wall and touches the periphery of the outer cylindrical surface 6 at the point of minimum thickness d of the elastomeric cylindrical wall. The radius r' of the generating semicircle of the annular section 9 amounts, for example, to 0.5 r. The whole cylinder 2 is connected to the base body 1 in an angular position in which the constriction 8 is oriented in the direction of the rear edge 4 of the sheet stack 5.

The operation of the tilting suction type separator 1, 2 and 3 of this invention is as follows:

Upon the abutment of the suction head 3 against the rear margin or edge 4 of the uppermost sheet on the stack 5 and upon application of vacuum into the interior of the base body 1 and of the hollow cylinder 2, the atmospheric pressure causes the deformation of the cylinder 2 in the region of the constriction 8 and consequently the height H of the cylinder is reduced at one side of the cylinder. By virtue of this deformation the suction head 3 and therewith the rear edge of the upper sheet are tilted upwardly.

After this tilting movement the vertical movement of the whole separating element 1, 2 and 3 takes place and the upper sheet is completely separated from the stack 5 and is taken over in known manner by the horizontally movable feeding suction element 12 to be forwarded for further processing.

When the vacuum in the hollow cylinder 2 is abolished, the latter resumes, due to the elasticity of its material, its normal nondeformed shape and is ready for another separating cycle.

It will be understood that each of the elements described above, or two or more together, may also find a useful application in other types of constructions differing from the types described above.

While the invention has been illustrated and described as embodied in a specific example of the tiltable suction separator, it is not intended to be limited to the details shown, since various modifications and structural changes may be made without departing in any way from the spirit of the present invention.

Without further analysis, the foregoing will so fully reveal the gist of the present invention, that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A tiltable suction type sheet separaor for use in a feeding apparatus of a sheet manufacturing or processing machine, comprising a rigid base body supported for a reciprocating movement in a vertical direction relative to a stack of sheets, a suction member connected to said body and including a downwardly projecting hollow cylinder of an elastomeric material, the center axis of the inner surface of said hollow cylinder being offset from the center axis of the outer surface to provide a cylindrical wall of a circumferentially varying thickness, said cylindrical wall having in the range of its smallest thickness a single recessed constriction extending in a plane which is parallel to the base plane of the hollow cylinder, said constriction having the form of an annular section the radius of which exceeds the radius of said outer cylindrical surface.

2. A sheet separator as defined in claim 1, wherein said center axis of said outer and inner cylindrical surfaces extend parallel to each other.

3. A sheet separator as defined in claim 1, wherein the plane of symmetry of said constriction extends substantially midway of the height of said hollow cylinder.

* * * * *